US006863775B2

(12) United States Patent
Bobsein et al.

(10) Patent No.: US 6,863,775 B2
(45) Date of Patent: Mar. 8, 2005

(54) PAPER HAVING IMPROVED PRINT QUALITY AND METHOD OF MAKING THE SAME

(75) Inventors: Barrett Richard Bobsein, Sellersville, PA (US); James Tinney Brown, Bechtelsville, PA (US); Zhenwen Fu, Lansdale, PA (US); Janet Drobits Windisch, Collegeville, PA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 10/382,828

(22) Filed: Mar. 6, 2003

(65) Prior Publication Data

US 2003/0178165 A1 Sep. 25, 2003

Related U.S. Application Data

(62) Division of application No. 09/825,303, filed on Apr. 4, 2001, now Pat. No. 6,547,929.

(60) Provisional application No. 60/196,374, filed on Apr. 12, 2000.

(51) Int. Cl.[7] ..... D21H 19/36; D21H 19/68; D21H 19/72; B41M 5/00

(52) U.S. Cl. ..... 162/135; 162/136; 162/158; 162/181.1; 162/204; 162/205; 162/207; 428/211.1; 428/342; 427/288; 427/361

(58) Field of Search ..... 430/538; 427/288, 427/326, 361, 411, 395; 162/119, 135–137, 158, 164.1, 175, 180, 181.1, 183, 184, 186, 204, 206, 207; 106/145, 600, 632, 656, 162.1, 400, 162.51; 428/144, 211, 195, 220, 206, 326, 330, 337–342, 537.5

(56) References Cited

U.S. PATENT DOCUMENTS

| | | | | | |
|---|---|---|---|---|---|
| 3,853,579 | A | | 12/1974 | Heiser | |
| 3,949,138 | A | | 4/1976 | Heiser | |
| 4,474,847 | A | * | 10/1984 | Schroder et al. | 428/32.35 |
| 4,624,744 | A | | 11/1986 | Vreeland | |
| 4,749,445 | A | | 6/1988 | Vreeland | |
| 4,751,111 | A | | 6/1988 | Lee et al. | |
| 5,283,129 | A | | 2/1994 | Renk et al. | |
| 5,454,864 | A | * | 10/1995 | Whalen-Shaw | 106/416 |
| 5,478,631 | A | | 12/1995 | Kawano et al. | |
| 5,510,422 | A | | 4/1996 | Blankenship et al. | |
| 5,563,201 | A | | 10/1996 | Joanicot et al. | |
| 5,840,789 | A | | 11/1998 | Verstrat et al. | |
| 5,861,209 | A | | 1/1999 | Haskins et al. | |
| 5,902,453 | A | * | 5/1999 | Ruch | 162/135 |
| 5,922,457 | A | | 7/1999 | Yanagisawa et al. | |
| 5,952,082 | A | * | 9/1999 | Normington et al. | 162/136 |
| 6,080,802 | A | | 6/2000 | Emmons et al. | |
| 6,262,152 | B1 | * | 7/2001 | Fryd et al. | 524/90 |
| 6,380,265 | B1 | | 4/2002 | Pryor et al. | |
| 6,635,694 | B1 | * | 10/2003 | Meyers et al. | 523/340 |

FOREIGN PATENT DOCUMENTS

| | | | | |
|---|---|---|---|---|
| EP | 0 179 597 A2 | | 4/1986 | |
| EP | 0 244 250 A1 | | 11/1987 | |
| EP | 0 342 283 | | 11/1989 | |
| EP | 0 825 296 A1 | | 2/1998 | |
| EP | 0 842 992 A2 | | 5/1998 | |
| WO | WO 87/02722 | | 5/1987 | |
| WO | WO 99/31320 | | 6/1999 | |
| WO | WO 99/63157 | | 12/1999 | |
| WO | WO 00/14165 | * | 3/2000 | C09C/3/10 |

OTHER PUBLICATIONS

English language translation of Japanese Laid–Open Patent Application Publication No. 5–230795(Sep. 7, 1993).

* cited by examiner

*Primary Examiner*—Steven P. Griffin
*Assistant Examiner*—Eric Hug
(74) *Attorney, Agent, or Firm*—Chipo M. Jolibois

(57) ABSTRACT

A paper having an improved print quality comprises a paper substrate having a surface with a surface roughness of less than 6 microns and a surface gloss of 5–80% which surface has been coated with a light-weight, low solids content, top coat. The top coat may comprise (i) a rheology modifier/binder component and at least one pigment or (ii) at least one binder coated pigment. The top coat provides a significant improvement to the delta gloss of the so-treated paper.

13 Claims, No Drawings

PAPER HAVING IMPROVED PRINT QUALITY AND METHOD OF MAKING THE SAME

This is a division of U.S. patent application Ser. No. 09/825,303 filed on Apr. 4, 2001, now U.S. Pat. No. 6,547,929, which claims the benefit of U.S. Provisional Application No. 60/196,374 filed on Apr. 12, 2000.

The present invention relates to a paper having the improved print quality of a heightened delta gloss and a method of producing the same.

Japanese Laid-Open Patent Application Publication No. 5-230795 discloses a paper coating composition containing pigment and adhesive as major components in which the pigment includes a plastic pigment having a vinyl aromatic monomer and an olefinic monomer as major components, the plastic pigment being present in an amount of 2–10 parts by weight per 100 parts by weight of total pigment, the plastic pigment having an average particle size of 30–100 nm. The coating composition is coated on a paper substrate to produce a matte coated paper having a low probability of regenerating gloss after coating while having excellent smoothness and strength. The paper substrate may be a top quality paper, an intermediate quality paper, paper sheets having a weight of 40–300 g/m$^2$ or a coated paper obtained by previously applying a coating composition on one or both surfaces, drying the coating and then calendering the coated, dried paper. The inventive coating composition, as shown in the working examples, is prepared as a dispersion in water having a solids content of 60% by weight and is applied at a coating rate of 15 g/m$^2$ dry weight.

European Published Patent Application No. 0 842 992 A2 discloses a low gloss coating composition, providing a coated paper having a sheet gloss of 50% or less, which is useful for improving the print quality of inks applied to a paper coated therewith, particularly, delta gloss, i.e., the difference in gloss between the substrate coated with the inventive composition and the ink applied to the so-coated substrate. The low gloss coating composition comprises one or more polymer particles and one or more pigments; wherein the polymer particles comprise at least one polymer core phase containing at least one void, at least one polymer shell phase at least partially surrounding the core and at least one channel connecting the void in the core to the exterior of the particle; and wherein the coating composition comprises 1.0 to 50 parts by weight of the polymer particles per 100 parts by weight of the pigment. The coating composition preferably contains water, solvent or combinations thereof. The water or solvent is preferably added in an amount to produce a solids content of 40 to 80 weight percent. The coating composition can be applied to a substrate in an amount of 0.15 to 45 g/m$^2$. Suitable substrates include, for example, paper; paper board; paper products used for newspapers, advertisements, posters, books or magazines; and building substrates such as wall paper, wall board or ceiling tile. In the working examples, typical North American freesheet base stock paper sheets, having a weight of about 61 g/m$^2$, were coated with the inventive composition having a solids content of between 52 and 58% by weight at a coating rate of 14.8 g/m$^2$.

U.S. Pat. No. 5,922,457 and European Published Patent Application No. 0 825 296 A1 both disclose a matte-finished coated paper comprising a paper web provided with a surface coating on at least one side containing polyolefin resin particles, an adhesive and a pigment. The pigment includes porous particles of organic pigment material and calcium carbonate particles. The porous particles of organic pigment material have an oil absorbency of 80 to 400 ml/100 g when measured pursuant to JIS K5101; each calcium carbonate particle has an average particle diameter of 1.0 to 10 microns; and each polyolefin resin particle has an average diameter of 8 to 30 microns. However, the surface coating of the matte-finished coated paper must be finished to satisfy the following three conditions: (i) a degree of gloss in the range of 1–10% (measurement condition: 75°) when measured pursuant to JIS P 8142; (ii) a smoothness in the range of 1–25 seconds when measured pursuant to JIS P8119; and (iii) a surface roughness $R_a$ in the range of 2.0 to 6.0 microns when measured pursuant to JIS B0601.

U.S. Pat. No. 4,751,111 discloses a method for producing low sheet gloss coated paper wherein the synthetic polymer latex binder that is used to coat the papers is a carboxylated latex which swells substantially during the preparation of the aqueous coating composition and subsequently shrinks during the drying of the coated paper, whereby a microscopic surface roughness is obtained to yield a low gloss coated paper while retaining high ink gloss.

Published International Patent Application No. WO 99/31320 discloses a dull cast-coated paper and a method for manufacturing the same. The coating has a topographical surface profile in which the average peak-to-valley height $R_a$ is from 0.1 to 0.5 micron, the maximum peak-to-valley height $R_t$ is from 1.0 to 4.5 microns and the wave height $W_t$ is less than 5.0 microns. In the process for production of the cast-coated paper, an aqueous coating composition, which contains pigment(s) and binder, is applied to at least one surface of a base paper, the coated surface is brought into contact with the surface of a heated cylinder, the coating is dried in contact with the cylinder and the dried paper is removed from the cylinder surface. The cylinder surface has a topographical surface profile in which the average peak-to-valley height $R_a$ is from 0.1 to 0.6 micron and the maximum peak-to-valley height $R_t$ is from 1.0 to 5.0 microns. The aqueous coating composition is applied to the base paper in an amount such that the coating weight after drying is from 10 to 30 g/cm$^2$.

It has been desired to obtain high print gloss and high print quality on low gloss substrates since such a combination provides an easy-to-read, low glare background combined with high gloss, high quality, eye-catching images and text. However, it has been very difficult to achieve an adequate balance between the two. The difference in gloss between the printed and non-printed areas of a coated substrate, referred to as "delta gloss" (or "snap"), is the most important parameter used to quantitatively assess the print quality of low gloss substrates. The demand for larger delta gloss is high. Other challenges in printing on low gloss substrates are to obtain uniform ink density and ink holdout. The fundamental difficulty for all of the above is probably due to the fact that low gloss substrates tend to be rough. Low gloss coated substrates have a 75° sheet gloss of 50% or less. In the paper industry, the low gloss coated substrates are referred to as silk, matte or dull grades for sheet gloss.

Two major techniques have been utilized to improve the print quality on low gloss coated substrates. One is by blending specialty pigments such as talc or alumina, or specialty binders such as highly carboxylated styrene/butadiene latexes, into the matte coating composition. The other is to use special calendering techniques. The improvement achieved by these techniques has tended to be less than desired.

It has now been found that the delta gloss of coated substrates can be significantly improved by the application of a low solids content, light-weight top coat composition.

In a first aspect of the present invention, there is provided a paper having an improved print quality, comprising:

(i) a paper substrate, said paper substrate having a front and a back, and a surface on at least one of said front and said back of said paper substrate, said surface having a surface roughness of less than 6 microns and a surface gloss of 5 to 80%; and (ii) a top coat disposed over said surface, said top coat comprising a rheology modifier/binder component and at least one pigment, said rheology modifier/binder component being present in an amount of 5–200 parts by weight for each 100 parts by weight of said at least one pigment, said at least one pigment having an average particle diameter of 200 to 2000 nm, said top coat being a partial monolayer of particles of said at least one pigment or clusters of said particles of said at least one pigment.

In a second aspect of the present invention, there is provided a process of making a paper having an improved print quality, comprising:

(i) providing a paper substrate, said paper substrate having a front and a back, and a surface on at least one of said front and said back of said paper substrate, said surface having a surface roughness of less than 6 microns and a surface gloss of 5 to 80%;

(ii) applying an aqueous top coat over said surface, said aqueous top coat having a solids content of 1 to 40% by weight, said aqueous top coat comprising water, a rheology modifier/binder component and at least one pigment, said rheology modifier/binder component being present in an amount of 5–200 parts by weight for each 100 parts by weight of said at least one pigment, said at least one pigment having an average particle diameter of 200 to 2000 nm, said top coat being a partial mono-layer of particles of said at least one pigment or clusters of said particles of said at least one pigment; and (iii) drying said aqueous top coat.

In a third aspect of the present invention, there is provided an aqueous coating composition comprising a rheology modifier/binder component and at least one pigment, the rheology modifier/binder component being present in an amount of 10 to 200 parts by weight for each 100 parts by weight of the at least one pigment, the at least one pigment having an average particle diameter of 200 to 2000 nm, the aqueous coating composition having a solids content of 1 to 40% by weight.

In a fourth aspect of the present invention, there is provided a paper having an improved print quality, comprising:

(i) a paper substrate, said paper substrate having a front and a back, and a surface on at least one of said front and said back of said paper substrate, said surface having a surface roughness of less than 6 microns and a surface gloss of 5 to 80%; and (ii) a top coat disposed over said surface, said top coat comprising at least one binder coated pigment, said binder being present in an amount of 1–50 wt % based on the weight of said at least one pigment, said at least one pigment having an average particle diameter of 200 to 2000 nm, said top coat being a partial monolayer of particles of said at least one pigment or clusters of said particles of said at least one pigment.

In a fifth aspect of the present invention, there is provided a process of making a paper having an improved print quality, comprising:

(i) providing a paper substrate, said paper substrate having a front and a back, and a surface on at least one of said front and said back of said paper substrate, said surface having a surface roughness of less than 6 microns and a surface gloss of 5 to 80%;

(ii) applying an aqueous top coat over said surface, said aqueous top coat having a solids content of 1 to 40% by weight, said aqueous top coat comprising water and at least one binder coated pigment, said binder being present in an amount of 1–50 wt % based on the weight of said at least one pigment, said at least one pigment having an average particle diameter of 200 to 2000 nm, said top coat being a partial mono-layer of particles of said at least one pigment or clusters of said particles of said at least one pigment; and (iii) drying said aqueous top coat.

In a sixth aspect of the present invention, there is provided an aqueous coating composition comprising at least one binder coated pigment, said binder being present in an amount of 1–50 wt % based on the weight of the at least one pigment, the at least one pigment having an average particle diameter of 200 to 2000 nm, the aqueous coating composition having a solids content of 1 to 40% by weight.

The paper substrate utilized in the present invention may include any conventionally available paper sheet such as, for example, paper sheet having a weight of 40–300 g/m$^2$.

The paper substrate has a surface formed on the front and/or the back thereof. The surface has a surface roughness of less than 6 microns, typically less than 5 microns, and a surface gloss of 5 to 80%, for example, 10 to 50%. The surface may be formed by a conventional paper coating composition such as, for example, a mineral coating composition, disposed on the front and/or the back of the paper substrate. In this case, the mineral coated substrate may be subjected to a calendering operation such as, for example, gloss calendering which uses heated rolls and nip loads of, typically, between about 87.5 to 175 KN/M (500 to 1,000 pounds per lineal inch); resulting in nip pressures of 6,890 KN/M$^2$ to 13,780 KN/M$^2$ (1,000 to 2,000 psi). Suitable gloss calendering techniques are disclosed in U.S. Pat. Nos. 3,124,504; 3,124,480; 3,124,481; 3,190,212; and 3,254,593.

Alternatively, the surface may be formed by calendering, e.g., supercalendering, the paper substrate or by thermal gradient smoothing.

Supercalendering typically involves passing the paper substrate through a series of nips formed by steel rolls pressed against cotton filled rolls at very high pressures, e.g., at nip loads between 175 KN/M and 437.5 KN/M (1,000 and 2,500 pounds per lineal inch) resulting in nip pressures of 13,780 KN/M$^2$ to 27,560 KN/M$^2$ (2,000 to 4,000 psi). Traditional supercalender stacks are not externally heated, but heat is generated when the cotton filled rolls, subjected to the extremely high pressures in the nip, flex intermittently with each revolution. The nip temperatures in such supercalenders typically reach levels of about 71° C. Moreover, the substrate should have a high moisture content as it passes through the supercalender. Typically, the moisture content will be 7% to 9%, or higher, of the bone dry fiber weight. A form of supercalendering in which the rolls are heated to relatively high temperatures is disclosed in U.S. Pat. Nos. 3,442,685 and 3,451,331.

Thermal gradient smoothing, typically, entails advancing a web of papermaking fibers through a nip formed by a smooth metal finishing drum and a resilient backing roll; and heating the drum to a temperature at least high enough to heat a substrate portion of the web to a temperature in which gloss and smoothness rapidly increase with increasing temperature due to thermoplastic molding of the substrate beneath the surface and at a temperature higher than where substantial gloss and smoothness would have already been obtained by molding of the surface of the web. Such processes are described in U.S. Pat. Nos. 4,624,744 and 4,749,445 and Published International Patent Application WO87/02722.

The top coat composition of the present invention is disposed over the surface formed on the front and/or the back of the paper substrate. The top coat of the present invention is formed as a partial mono-layer of particles of pigment. (A mono-layer, for purposes of this invention, is defined as a layer of the pigment particles or their aggregates (clusters), if the pigment particles are aggregated under the coating condition, which is one particle (or cluster) thick and wherein the particles (or clusters) are subject to closest packing, e.g., in the case of substantially spherical particles (or clusters), hexagonal close packing. Typically, the partial mono-layer of the present invention would provide a surface coverage which is 5–95% of that achieved by the closest packing, preferably 20–80% of that of the closest packing, more preferably 30–70% of that of the closest packing. The achievement of such a partial mono-layer can be monitored by Scanning Electron Microscopy.)

The top coat may have a dry weight (coat weight) of 0.01 to 5 $g/m^2$, for example 0.01 to 4 $g/m^2$, typically 0.2 to 3 $g/m^2$, more typically 0.2 to 2 $g/m^2$. As will be appreciated, to achieve the above-noted partial mono-layer structure, the required coat weight will depend on the pigment density, the pigment particle size and whether the pigment particles are aggregated (clustered). For example, for a hollow sphere plastic pigment with a density of 0.61 $g/cm^3$ and a particle diameter of 0.6 micron, coverage of 5–95% of that of closest packing is equal to 0.01 $g/m^2$ to 0.21 $g/m^2$ coat weight; whereas, for a calcium carbonate pigment with a density of 2.65 $g/cm^3$ and a particle diameter of 1 micron, coverage of 5–95% of that of closest packing is equal to 0.16 $g/m^2$ to 3.04 $g/m^2$ coat weight.

In one embodiment, the top coat comprises a rheology modifier/binder component and at least one pigment. The rheology modifier/binder component is present in an amount of 5–200 parts by weight for each 100 parts by weight of the pigment, typically 10–120 parts by weight for each 100 parts by weight of the pigment, more typically 20–100 parts by weight for each 100 parts by weight of the pigment. The at least one pigment has an average particle diameter of 200 to 2000 nm, preferably 200 to 1000 nm, more preferably 300 to 1000 nm.

The rheology modifier/binder component may comprise a rheology modifier, a rheology modifier and a binder, or a binder. Typically, the rheology modifier/binder component provides a top coat composition viscosity appropriate for the chosen method of application, as would be known to those of ordinary skill in the art; and also acts as the adhesive adhering the pigment to the surface.

A rheology modifier, as is well known, is a material that is generally used to adjust or modify the rheological properties of aqueous compositions. Such properties include viscosity, flow rate, stability to viscosity change over time, and the ability to suspend particles in the aqueous composition. Suitable rheology modifiers include, for example, alkali-soluble or -swellable emulsion acrylic copolymers (ASEs) such as, for example, RHOPLEX ASE-60, ASE-75, ASE-95NP and ASE-108NP (Rohm and Haas Company, Philadelphia, Pa.); hydrophobically modified ASEs (HASEs) such as, for example, RHOPLEX TT-935 (Rohm and Haas Company, Philadelphia, Pa.); non-ionic ethylene oxide based urethane block copolymers (HEURs), such as, for example, RHOPLEX RM-825 (Rohm and Haas Company, Philadelphia, Pa.); polyvinyl alcohols; starches; proteins; cellulose derivatives such as carboxymethyl cellulose (CMC), hydroxyethyl cellulose (HEC) and methyl cellulose; and maleic anhydride copolymers. Among these, the ASEs are the most preferred rheology modifiers for the present invention.

Due to the low solids content and the high rheology modifier loading of the present top coat compositions, the rheology modifier utilized in the top coat composition is usually enough to provide adequate adhesive strength of the coating to the surface. In cases where the adhesive strength provided by the rheology modifier is insufficient, conventional binders, such as, for example, styrene-butadiene polymers, acrylic polymers, styrene-acrylic polymers, and vinyl acetate and ethylene-vinyl acetate polymers, may be added in amounts of up to 40 parts by weight for each 100 parts by weight of pigment. Typical examples of such binders include acrylic polymers such as RHOPLEX B-15 and RHOPLEX P-376, and vinyl acetate/acrylic polymers such as Polyco 2152 and Polyco 3250, all made by Rohm and Haas Company (Philadelphia, Pa.); and styrene/butadiene polymers such as CP 620 made by Dow Chemical Company (Midland, Mich.).

Binders which can provide both the desired viscosity and adhesive strength include alkali swellable vinyl acetate/acrylic polymers such as Polyco 3250 and self-thickening styrene acrylic polymers such as Primal 425GTB, both made by Rohm and Haas Company (Philadelphia, Pa.).

The at least one pigment utilized in the top coat composition of the present invention includes mineral pigments and synthetic plastic pigments. Suitable synthetic plastic pigments include, for example, hollow sphere pigments such as ROPAQUE HP543, HP91 and HP1055, all made by Rohm and Haas Company (Philadelphia, Pa.); solid polystyrene bead particles such as DOW711 and DOW722, both made by Dow Chemical Company (Midland, Mich.); solid polymethylmethacrylate bead particles; polymer particles with a morphology (particles comprising at least one polymer core phase containing at least one void, at least one polymer shell phase at least partially surrounding the core, and at least one channel connecting the void in the core to the exterior of the particle) and composition defined in U.S. Pat. No. 5,510,422 and European Published Patent Application No. 0 842 992 A2; and any polymer particles with a glass transition temperature greater than 40° C. For polystyrene particles, the average particle size is desirably greater than 300 nm, more desirably greater than 500 nm, and most desirably greater than 700 nm. For polymethylmethacrylate particles, the average particle size is desirably greater than 200 nm, more desirably greater than 400 nm, and most desirably greater than 500 nm. Suitable mineral pigments include, for example, ground and precipitated calcium carbonate, kaolin, calcined kaolin, delaminated and structured kaolin clay, titanium oxide, aluminum silicate, magnesium silicate, magnesium carbonate, amorphous silica, zinc oxide, zinc hydroxide, aluminum oxide, aluminum hydroxide, talc, satin white, barium sulfate and calcium silicate.

In another embodiment, the top coat comprises at least one binder coated pigment. The binder is present in an amount of 1–50 wt % binder based on the weight of the pigment. The amount of binder may vary within the aforementioned range, in that, typically, less binder is required with higher density pigments and more binder is required with lower density pigments. As in the previous embodiment, the at least one pigment has an average particles size of 200 to 2000 nm; preferably 200 to 1000 nm, more preferably 300 to 1000 nm. Suitable binders include, for example, styrene-butadiene polymers, acrylic polymers, styrene-acrylic polymers, and vinyl acetate and ethylene-vinyl acetate polymers. The exterior of the pigment particle or cluster may be coated partially or totally with a binder polymer so that the individual pigment particle or cluster adheres with sufficient strength to the substrate surface so that it is not removed during calendering, printing or use. An example of a binder coated pigment is Ropaque BC-643 made by Rohm and Haas Company (Philadelphia, Pa.). The coating of binder on the exterior of the pigment particle may, for example, be accomplished by polymerizing monomer onto the pigment surface, by depositing polymer from solution or by colloidally associating latex polymer particles to the surface of the pigment particle as in U.S. Pat. No. 6,080,802.

Once again, the at least one pigment includes mineral pigments, synthetic plastic pigments and mixtures thereof. Suitable synthetic plastic pigments include, for example, hollow sphere pigments such as ROPAQUE HP543, HP91 and HP1055, all made by Rohm and Haas Company (Philadelphia, Pa.); solid polystyrene bead particles such as DOW711 and DOW722, both made by Dow Chemical Company (Midland, Mich.); solid polymethylmethacrylate bead particles; polymer particles with a morphology (particles comprising at least one polymer core phase containing at least one void, at least one polymer shell phase at least partially surrounding the core, and at least one channel connecting the void in the core to the exterior of the particle) and composition defined in U.S. Pat. No. 5,510,422 and European Published Patent Application No. 0 842 992 A2; and any polymer particles with a glass transition temperature greater than 40° C. For polystyrene particles, the average particle size is desirably greater than 300 nm, more desirably greater than 500 nm, and most desirably greater than 700 nm. For polymethylmethacrylate particles, the average particle size is desirably greater than 200 nm, more desirably greater than 400 nm, and most desirably greater than 500 nm. Suitable mineral pigments include, for example, ground and precipitated calcium carbonate, kaolin, calcined kaolin, delaminated and structured kaolin clay, titanium oxide, aluminum silicate, magnesium silicate, magnesium carbonate, amorphous silica, zinc oxide, zinc hydroxide, aluminum oxide, aluminum hydroxide, talc, satin white, barium sulfate and calcium silicate.

The top coat composition of the present invention may further include other conventional paper coating materials, especially surface property enhancing materials such as, for example, optical brightening agents (OBAs) as well as their conventional adjuvants, in so far as they do not detract from the present invention. This produces greater efficiency in the utilization of such surface property enhancing materials since the materials are concentrated in the light-weight top coat on the outer surface, which is relatively thin; rather than being present in a relatively thick heavier weight coating on the paper or permeated throughout the body of the paper.

The optical brightening agent may be utilized in an amount of 0.1 to 20 parts by weight for each 100 parts by weight of the at least one pigment, preferably in an amount of 0.1 to 10 parts by weight for each 100 parts by weight of the at least one pigment. An adjuvant for the optical brightening agent, e.g., a carrier such as polyvinyl alcohol, may also be utilized in the composition, in an amount of 1 to 30 parts by weight per 100 parts by weight of the at least one pigment.

The top coat composition of the present invention is formulated as an aqueous composition having a solids content of 1 to 40% by weight, preferably 10 to 40% by weight, most preferably 25 to 35% by weight.

This aqueous composition may be coated on the surface of the paper by any conventional paper coating technique, as well as by spraying or by print press, e.g., rotogravure, and is then dried in a conventional manner.

If desired, subsequent to drying, the dried paper may be calendered so as to produce a surface gloss of not more than 50%. Typically, for example, such calendering can be effected at a speed of 600 feet per minute (fpm), a temperature of 130° F., a pressure of 10–30 pounds per square inch (psi) for one or more nips. Typically, calendering enhances smoothness and printability.

EXAMPLES

The aqueous top coat composition of the present invention was coated on the following pre-coated papers:

Sheet-A: Freesheet basestock coated (13.5 g/m$^2$) with a typical matte coating formulation, provided by International Paper.

Sheet-B: Groundwood base stock coated (7.5 g/m$^2$) with formulation I, shown in Table I, coated at the Finnish Pulp and Paper Research Institute pilot coating machine.

Sheet-C: Freesheet base stock coated (10.5 g/m$^2$) with formulation II, shown in Table I, coated at the Finnish Pulp and Paper Research Institute pilot coating machine.

TABLE I

| Ingredients | Formulation I(1) | Formulation II(1) |
|---|---|---|
| Nuclay(2) | 70 | |
| HT-Pred #2 clay(3) | 20 | |
| Carbilux(4) | | 90 |
| Ultrawhite(5) | | 10 |
| Ansilex 93(6) | 10 | |
| Raisamyl 304E(7) | 5 | |
| Dow 945(8) | 10 | 14 |
| Glyoxal T(9) | 0.5 | |
| Finnfix 5G(10) | | 0.4 |
| Blankophor p(11) | 0.5 | 0.5 |

(1)Parts by weight
(2)Regular delaminated clay with 87.5–89 brightness (Engelhard Mineral & Chemical Corp.)
(3)#2 clay with 85.5–86 brightness, particle size = 80% less than 2 μm (Engelhard Mineral & Chemical Corp.)
(4)Calcium carbonate with 95–97 brightness, median particle size = 0.55 μm with 99% less than 2 μm (ECC International)
(5)#1 high brightness coating clay with 90–92 brightness, particle size = 90–94% less than 2 μm (Engelhard Mineral & Chemical Corp.)
(6)Calcined clay with 92.5–93.5 brightness, particle size = 88–90% less than 2 μm (Engelhard Mineral & Chemical Corp.)
(7)Starch binder (Raisio Chemicals)
(8)Latex binder (Dow Chemicals)
(9)Crosslinker (Clariant)
(10)Carboxymethylcellulose (Metsa Specialty Chemicals)
(11)Optical brightening agent (Bayer)

Examples 1–6

A pre-dispersed pigment or organic particle latex was first diluted to the desired concentration with tap water, then the rheology modifier emulsion or solution and any other ingredients were added while stirring to form the coating composition. After all of the ingredients were mixed, the pH of the coating composition was adjusted to a pH of 8.5 to 9 with aqueous ammonium hydroxide (28 weight percent).

Each coating composition was applied to a number of pre-coated paper sheets (9 inches by 12 inches). The composition was drawn down by hand onto the paper sheet using a #4, #5 or #6 Meyer wire wound rod. Due to the low solids content of the coating composition, the coat weight was too low to be measured accurately. The estimated coat weights were usually less than 1.5 g/m$^2$ and typically less than 1.0 g/m$^2$. Each coated paper sheet was oven dried at 80° C. for one minute and then conditioned overnight at about 22° C. and 50% humidity.

The sheets were calendered at equal and/or different conditions to produce a constant sheet gloss. Before and after calendering, sheets were evaluated for various properties.

Brightness was measured using a Technidyne Brightmeter Model S4-M (Technidyne, New Albany, Ind.). The test method for measuring brightness was TAPPI Test Method T-452 published in "TAPPI Test Methods 1994–1995" by TAPPI Press (Atlanta, Ga.).

Sheet gloss and print gloss were measured at a 75° angle using a Technidyne T480 Glossmeter (Technidyne, New Albany, Ind.). The test method for measuring gloss was TAPPI Test Method T-480 published in "TAPPI Test Methods 1994–1995" by TAPPI Press (Atlanta, Ga.).

Opacity was measured using a Technidyne BNL-2 Opacimeter (Technidyne, New Albany, Ind.). The test method for measuring opacity was TAPPI Test Method T-425 published in "TAPPI Test Methods 1994–1995" by TAPPI Press (Atlanta, Ga.).

Delta gloss, the difference in gloss between a printed and unprinted area of a substrate, was determined as follows: Coated, calendered sheets were cut into 4.7 cm by 23 cm strips. Sheet gloss for each strip was measured at 5 points along each strip. The strip was then printed to cover its entire surface with ink using a Prufbau Printer (Prufbau, Munich, Germany) at a print speed of 0.5 meters/second, pressure on the form roll of 800 Newtons, ink volume of 0.15 milliliter, ink distribution time on the blanket roll of 45 seconds and ink distribution time on the form roll of 15 seconds. The ink was a black, heat-set ink. After printing, the strips were heat dried at about 50° C. for 2 minutes. The printed strips were then conditioned overnight at about 22° C. and 50% humidity. The gloss for each printed strip was measured the same way as for the strip prior to printing. The delta gloss was calculated by subtracting the averaged sheet gloss of the strips before printing from the averaged print gloss of the printed strips.

Smoothness was measured with a Parker Print-SURF Roughness Tester (Model No. ME-90) made by Messmer Instruments, Ltd. Five sheets were selected and the surface roughness was measured at four different points on each sheet. The averaged value of surface roughness for the twenty points was reported as the smoothness value.

The viscosity of the coating compositions was measured using a Brookfield LVF viscometer, Spindle 3, at 60 rpm. The viscosity of the compositions ranged from 700 to about 2000 centipoises.

Table 1 sets forth the coating compositions for the aqueous top coat compositions of Examples 1–6.

TABLE 1

| Example | Pigment[1] (% by wt.) | Rheology Modifier[2] (% by wt.) | Total Solids (% by wt.) |
|---|---|---|---|
| 1* | 0.00 | 0.00 | 0.00 |
| 2 | 0.00 | 1.00 | 1.00 |
| 3 | 0.50 | 1.00 | 1.50 |
| 4 | 1.00 | 1.00 | 2.00 |
| 5 | 2.00 | 1.00 | 3.00 |
| 6 | 4.00 | 1.00 | 5.00 |

*Control: Sheet-A without any top coat
[1]EXP3637—experimental organic particle pigment with morphology and composition as defined in EP 0 842 992 A2, having a mean particle size of 600 nm (Rohm and Haas Company)
[2]ASE-60 (Rohm and Haas Company)

Table 2 sets forth properties before calendering for the coated sheets of Examples 1–6.

TABLE 2

| Example | Brightness (%) | Opacity (%) | Sheet Gloss (%) | Smoothness (microns) |
|---|---|---|---|---|
| 1* | 84.0 | 92.3 | 15.7 | 4.10 |
| 2 | 83.0 | 92.4 | 19.9 | 4.33 |
| 3 | 83.3 | 92.3 | 6.5 | 4.24 |
| 4 | 83.6 | 92.5 | 5.2 | 4.09 |
| 5 | 83.7 | 92.5 | 4.7 | 4.06 |
| 6 | 83.7 | 92.6 | 4.2 | 4.04 |

*Control: Sheet-A without any top coat.

All of the formulations have the same rheology modifier concentration, 1%, and different levels of the organic particle pigment EXP3637, from 0.5 to 4%. The total solids content ranges from 1 to 5%. The 1% of the ASE-60 rheology modifier provides adequate viscosity for the composition during coating and adequate binding strength in the dry state. It is surprising that the so-coated compositions reduce the sheet gloss significantly without increasing the surface roughness for printing or altering other properties such as brightness and opacity. At the 0.5% pigment level, the gloss reduction is already significant and it is only slightly better at higher levels.

Table 3 sets forth properties after calendering for the coated sheets of Examples 1–6. The sheets were calendered to a targeted gloss of 30%.

TABLE 3

| Example | Sheet Gloss[1] (%) | Print Gloss (%) | Delta Gloss | Change In Delta Gloss[2] |
|---|---|---|---|---|
| 1* | 30.74 | 58.0 | 27.2 | — |
| 2 | 31.72 | 57.5 | 25.8 | −1.4 |
| 3 | 29.34 | 67.6 | 38.2 | 11.0 |
| 4 | 29.88 | 69.6 | 39.7 | 12.5 |
| 5 | 29.96 | 70.1 | 40.1 | 12.9 |
| 6 | 30.10 | 74.6 | 44.5 | 17.3 |

*Control: Sheet-A without any top coat.
[1]Example 1 was calendered at 30 psi, 130° F. and 600 fpm one nip, Example 2 was calendered at 10 psi, 130° F. and 600 fpm one nip and Examples 3–6 were calendered at 30 psi, 130° F. and 600 fpm four nips.
[2]Change In Delta Gloss = (Delta Gloss of Example n (n = 2, 3, 4, 5 or 6)) minus (Delta Gloss of Example 1).

Compared to the control without any top coat (Example 1) and the control which only coated with the rheology modifier ASE-60 (Example 2), the Sheets of Examples 3–6 are extremely resistant to sheet gloss development. They require more severe calender conditions to achieve the targeted gloss and, therefore, provide a low gloss but nonetheless smooth surface for printing. The delta gloss for the sheets of Examples 3–6 is improved by about 11 to 17 units control without any top coat (Example 1).

Table 4 sets forth properties after calendering for the coated sheets of Examples 1–6. The sheets were all calendered under the same conditions (20 psi, 130° F., and 600 fpm).

TABLE 4

| Example | Smoothness (microns) | Sheet Gloss (%) | Print Gloss (%) | Delta Gloss | Change In Delta Gloss[1] |
|---|---|---|---|---|---|
| 1* | 2.19 | 29.4 | 57.2 | 27.8 | — |
| 2 | 2.06 | 35.1 | 62.2 | 27.0 | −0.8 |
| 3 | 2.04 | 21.8 | 63.7 | 41.9 | 14.1 |
| 4 | 1.92 | 19.5 | 63.8 | 44.3 | 16.5 |
| 5 | 1.89 | 19.5 | 64.5 | 45.0 | 17.2 |
| 6 | 1.86 | 19.9 | 66.1 | 46.2 | 18.4 |

*Control: Sheet-A without any top coat.
[1]Change In Delta Gloss = (Delta Gloss of Example n (n = 2, 3, 4, 5 or 6)) minus (Delta Gloss of Example 1).

Under the same calender conditions, as utilized for Table 4, the delta gloss for the sheets of Examples 3–6 is improved by about 14 to 18 units over the control without any top coat.

Examples 7–16

Coated sheets were prepared and tested as in Examples 1–6, except as otherwise noted. Table 5 sets forth the coating compositions for the aqueous top coat compositions of Examples 7–16.

TABLE 5

| Example | Pigment Type | Pigment (% by wt.) | Rheology Modifier[1] (% by wt.) | Total Solids (% by wt.) |
|---|---|---|---|---|
| 7* | | 0.00 | 0.00 | 0.00 |
| 8 | | 0.00 | 1.00 | 1.00 |
| 9 | EXP3637[2] | 1.00 | 1.00 | 2.00 |
| 10 | EXP3637[2] | 2.00 | 1.00 | 3.00 |
| 11 | HP1055[3] | 1.00 | 1.00 | 2.00 |
| 12 | HP1055[3] | 2.00 | 1.00 | 3.00 |
| 13 | HP543[4] | 1.00 | 1.00 | 2.00 |
| 14 | HP543[4] | 2.00 | 1.00 | 3.00 |
| 15 | DOW722[5] | 1.00 | 1.00 | 2.00 |
| 16 | DOW722[5] | 2.00 | 1.00 | 3.00 |

*Control: Sheet-A without any top coat.
[1]ASE-60 (Rohm and Haas Company)
[2]Experimental organic particle pigment with morphology and composition as defined in EP 0 842 992 A2, having a mean particle size of 600 nm (Rohm and Haas Company)
[3]Hollow sphere acrylic plastic pigment having a mean particle size of 1000 nm (Rohm and Haas Company)
[4]Hollow sphere acrylic plastic pigment having a mean particle size of 500 nm (Rohm and Haas Company)
[5]Polystyrene plastic pigment, mean particle size = 500 nm (Dow Chemical)

Table 6 sets forth properties before calendering for the coated sheets of Examples 7–16.

TABLE 6

| Example | Brightness (%) | Opacity (%) | Sheet Gloss (%) |
|---|---|---|---|
| 7* | 84.1 | 92.4 | 14.1 |
| 8 | 83.6 | 92.6 | 15.9 |
| 9 | 83.7 | 92.2 | 4.7 |
| 10 | 83.7 | 92.4 | 4.8 |
| 11 | 84.2 | 92.6 | 6.3 |
| 12 | 84.2 | 92.9 | 6.1 |
| 13 | 84.1 | 92.5 | 6.1 |
| 14 | 84.2 | 92.7 | 6.1 |

TABLE 6-continued

| Example | Brightness (%) | Opacity (%) | Sheet Gloss (%) |
|---|---|---|---|
| 15 | 83.9 | 92.6 | 9.5 |
| 16 | 84.1 | 92.6 | 9.9 |

*Control: Sheet-A without any top coat.

The EXP3637 pigment is the most effective in reducing the sheet gloss while the DOW722 solid bead is the least effective.

Table 7 sets forth properties after calendering for the coated sheets of Examples 7–16. All of the sheets were calendered to a targeted gloss of 30% at various conditions.

TABLE 7

| Example | Calender Conditions (130° F., 600 fpm) | Smoothness (microns) | Sheet Gloss (%) | Print Gloss (%) | Delta Gloss | Change In Delta Gloss** |
|---|---|---|---|---|---|---|
| 7* | (1) | 1.85 | 28.2 | 54.9 | 26.7 | — |
| 8 | (1) | 1.79 | 30.1 | 56.7 | 26.7 | 0.0 |
| 9 | (2) | 1.20 | 31.6 | 70.9 | 39.2 | 12.5 |
| 10 | (3) | 1.25 | 30.4 | 70.0 | 39.7 | 13.0 |
| 11 | (4) | 1.93 | 31.5 | 51.0 | 19.6 | −7.1 |
| 12 | (4) | 1.79 | 43.8 | 55.4 | 11.6 | −15.1 |
| 13 | (5) | 1.69 | 30.8 | 62.2 | 31.4 | 4.7 |
| 14 | (4) | 1.89 | 32.1 | 57.3 | 25.2 | −1.5 |
| 15 | (6) | 1.59 | 30.5 | 64.9 | 34.4 | 7.7 |
| 16 | (1) | 1.69 | 30.5 | 63.5 | 33.0 | 6.3 |

*Control: Sheet-A without any top coat.
**Change In Delta Gloss = (Delta Gloss of Example n (n = 8, 9, 10, 11, 12, 13, 14, 15 or 16)) minus (Delta Gloss of Example 7).
(1) 5 psi one nip and 10 psi two nips.
(2) 5 psi one nip, 10 psi two nips and 30 psi four nips.
(3) 5 psi one nip, 10 psi three nips and 30 psi three nips.
(4) 5 psi one nip.
(5) 5 psi one nip and 10 psi one nip.
(6) 5 psi one nip and 10 psi two nips.

The compositions with the EXP3637 pigment are most resistant to gloss development and produce the smoothest printing surface when calendered to the targeted gloss of 30%. The DOW722 solid bead is second to the EXP3637 pigment and the HP1055 pigment is least resistant to gloss development. The delta gloss is improved by about 12 to 13 units for the EXP3637 pigment-containing formulations, about 6 to 8 units for the solid bead-containing formulations, and about 5 units for the 1% HP543-containing formulation.

Examples 17–26

The same compositions of Examples 7–16 were coated on a different pre-coated substrate, i.e., Sheet-B (formulation I of Table I coated on groundwood base stock). The coated sheets were prepared and tested as in Examples 1–6, except otherwise noted. Table 8 sets forth the coating compositions for the aqueous top coat compositions of Examples 17–26. Similar trends are seen for these sheets, but even better improvement in delta gloss is achieved for this substrate.

TABLE 8

| Example | Pigment Type | Pigment (% by wt.) | Rheology Modifier[1] (% by wt.) | Total Solids (% by wt.) |
|---|---|---|---|---|
| 17* | | 0.00 | 0.00 | 0.00 |
| 18 | | 0.00 | 1.00 | 1.00 |

TABLE 8-continued

| Example | Pigment Type | Pigment (% by wt.) | Rheology Modifier[1] (% by wt.) | Total Solids (% by wt.) |
|---|---|---|---|---|
| 19 | EXP3637[2] | 1.00 | 1.00 | 2.00 |
| 20 | EXP3637[2] | 2.00 | 1.00 | 3.00 |
| 21 | HP1055[3] | 1.00 | 1.00 | 2.00 |
| 22 | HP1055[3] | 2.00 | 1.00 | 3.00 |
| 23 | HP543[4] | 1.00 | 1.00 | 2.00 |
| 24 | HP543[4] | 2.00 | 1.00 | 3.00 |
| 25 | DOW722[5] | 1.00 | 1.00 | 2.00 |
| 26 | DOW722[5] | 2.00 | 1.00 | 3.00 |

*Control: Sheet-B without any top coat.
[1]ASE-60
[2]Experimental organic particle pigment with morphology and composition as defined in EP 0 842 992 A2, having a mean particle size of 600 nm (Rohm and Haas Company)
[3]Hollow sphere acrylic plastic pigment with mean particle size of 1000 nm (Rohm and Haas Company)
[4]Hollow sphere acrylic plastic pigment with mean particle size of 500 nm (Rohm and Haas Company)
[5]Polystyrene plastic pigment, mean particle size = 500 nm (Dow Chemical)

Table 9 sets forth properties before calendering for the coated sheets of Examples 17–26.

TABLE 9

| Example | Brightness (%) | Opacity (%) | Sheet Gloss (%) |
|---|---|---|---|
| 17* | 74.4 | 90.4 | 14.8 |
| 18 | 73.8 | 89.7 | 14.8 |
| 19 | 74.1 | 90.3 | 3.9 |
| 20 | 74.4 | 90.4 | 3.9 |
| 21 | 74.8 | 90.3 | 5.1 |
| 22 | 75.3 | 90.8 | 4.6 |
| 23 | 75.1 | 90.6 | 4.9 |
| 24 | 75.3 | 91.1 | 4.7 |
| 25 | 74.1 | 90.2 | 8.0 |
| 26 | 75.3 | 90.6 | 7.9 |

*Control: Sheet-B without any top coat.

Table 10 sets forth properties after calendering for the coated sheets of Examples 7–26. All of the sheets were calendered to a targeted gloss of about 30% at various conditions.

TABLE 10

| Example | Smoothness (microns) | Sheet Gloss (%) | Print Gloss (%) | Delta Gloss | Change In Delta Gloss** |
|---|---|---|---|---|---|
| 17* | 2.65 | 27.6 | 49.7 | 22.2 | — |
| 18 | 2.51 | 30.3 | 49.9 | 19.5 | −2.6 |
| 19 | 1.89 | 25.0 | 64.0 | 39.0 | 16.8 |
| 20 | 1.68 | 25.9 | 66.5 | 40.5 | 18.4 |
| 21 | 2.01 | 31.0 | 56.4 | 25.4 | 3.2 |
| 22 | 2.48 | 30.7 | 48.2 | 17.6 | −4.6 |
| 23 | 2.08 | 28.5 | 59.0 | 30.5 | 8.3 |
| 24 | 1.93 | 36.7 | 65.5 | 28.8 | 6.6 |
| 25 | 1.74 | 32.2 | 66.1 | 33.9 | 11.7 |
| 26 | 2.14 | 29.0 | 58.1 | 29.2 | 7.0 |

*Control: Sheet-B without any top coat.
**Change In Delta Gloss = (Delta Gloss of Example n (n = 18, 19, 20, 21, 22, 23, 24, 25 or 26)) minus (Delta Gloss of Example 17).

Examples 27–34

Coated sheets were prepared utilizing a different substrate, i.e., Sheet-C (formulation II of Table I coated on a freesheet base stock). The coated sheets were prepared and tested as in Examples 1–6, except as otherwise noted. Table 11 sets forth the coating compositions for the aqueous top coat compositions of Examples 27–34.

TABLE 11

| Example | Pigment Type | Pigment (% by wt.) | Rheology Modifier[1] (% by wt.) | OBA[2] (% by wt.) | PVOH[3] (% by wt.) | Total Solids (% by wt.) |
|---|---|---|---|---|---|---|
| 27* | | 0.00 | 0.00 | 0.00 | 0.00 | 0.00 |
| 28 | | 0.00 | 1.00 | 0.00 | 0.00 | 1.00 |
| 29 | EXP3637[4] | 1.00 | 1.18 | 0.00 | 0.00 | 2.18 |
| 30 | EXP3637[4] | 1.00 | 1.18 | 0.07 | 0.00 | 2.25 |
| 31 | EXP3637[4] | 1.00 | 1.18 | 0.07 | 0.25 | 2.50 |
| 32 | DOW722[5] | 1.00 | 1.00 | 0.00 | 0.00 | 2.00 |
| 33 | DOW722[5] | 1.00 | 1.00 | 0.07 | 0.00 | 2.07 |
| 34 | DOW722[5] | 1.00 | 1.00 | 0.07 | 0.25 | 2.32 |

*Control: Sheet-C without any top coat.
[1]ASE-60 (Rohm and Haas Company)
[2]Optical Brightening Agent - Blankophor p (Bayer)
[3]Polyvinyl Alcohol
[4]Experimental organic particle pigment with morphology and composition as defined in EP 0 842 992 A2, having a mean particle size of 600 nm (Rohm and Haas Company)
[5]Polystyrene plastic pigment, mean particle size = 500 nm (Dow Chemical)

Table 12 sets forth properties before calendering for the coated sheets of Examples 27–34.

TABLE 12

| Example | Smoothness (microns) | Brightness (%) | Opacity (%) | Sheet Gloss (%) |
|---|---|---|---|---|
| 27* | 2.57 | 89.9 | 91.5 | 33.2 |
| 28 | 2.93 | 88.9 | 91.4 | 41.8 |
| 29 | 2.81 | 88.8 | 91.6 | 7.7 |
| 30 | 2.81 | 89.1 | 91.6 | 7.9 |
| 31 | 2.83 | 90.0 | 91.6 | 7.9 |
| 32 | 2.86 | 89.2 | 91.7 | 20.5 |
| 33 | 2.85 | 89.6 | 91.6 | 20.6 |
| 34 | 2.86 | 90.4 | 91.7 | 21.2 |

*Control: Sheet-C without any top coat.

Again, the compositions containing the EXP3637 pigment are the most effective in reducing sheet gloss without altering other properties. Moreover, the incorporation of the optical brightening agent produces a significant increase in brightness, especially in the presence of the polyvinyl alcohol adjuvant.

Tables 13 and 14 set forth various properties, after calendering, for the coated sheets of Examples 27–34. All of the sheets were calendered under the same conditions (30 psi, 130° F. and 600 fpm).

TABLE 13

| Example | Smoothness (microns) | Brightness (%) | Opacity (%) |
|---|---|---|---|
| 27* | 1.38 | 89.5 | 90.7 |
| 28 | 1.47 | 88.5 | 90.7 |
| 29 | 1.43 | 88.6 | 91.0 |
| 30 | 1.49 | 88.8 | 90.9 |
| 31 | 1.43 | 89.7 | 90.8 |
| 32 | 1.33 | 88.9 | 90.9 |
| 33 | 1.38 | 89.2 | 90.9 |
| 34 | 1.39 | 90.2 | 91.0 |

*Control: Sheet-C without any top coat.

TABLE 14

| Example | Sheet Gloss (%) | Print Gloss (%) | Delta Gloss | Change In Delta Gloss** |
|---|---|---|---|---|
| 27* | 56.6 | 85.7 | 29.1 | — |
| 28 | 65.6 | 86.6 | 21.0 | −8.1 |
| 29 | 31.7 | 82.8 | 51.1 | 22.0 |
| 30 | 31.8 | 86.1 | 54.3 | 25.2 |
| 31 | 32.0 | 86.4 | 54.4 | 25.3 |
| 32 | 49.7 | 88.5 | 38.8 | 9.7 |
| 33 | 48.1 | 86.4 | 38.3 | 9.2 |
| 34 | 48.3 | 87.0 | 38.7 | 9.6 |

*Control: Sheet-C without any top coat.
**Change In Delta Gloss = (Delta Gloss of Example n (n = 28, 29, 30, 31, 32, 33 or 34)) minus (Delta Gloss of Example 27).

The compositions with EXP3637 pigment are much more resistant to sheet gloss development during calendering. Moreover, the compositions with EXP367 pigment improve the delta gloss over the control without any top coat (Example 27) by about 22 to 25 units, whereas the compositions with the solid bead pigment improve the delta gloss by about 9 to 10 units.

Tables 15 and 16 set forth various properties, after calendering, for the coated sheets of Examples 27–34. All of the sheets were calendered to a targeted sheet gloss of about 30% under different conditions.

TABLE 15

| Example | Smoothness (microns) | Brightness (%) | Opacity (%) |
|---|---|---|---|
| 27* | 2.57 | 89.9 | 91.5 |
| 28 | 2.93 | 88.9 | 91.4 |
| 29 | 1.43 | 88.6 | 91.0 |
| 30 | 1.49 | 88.8 | 90.9 |
| 31 | 1.43 | 89.7 | 90.8 |
| 32 | 1.91 | 89.2 | 91.4 |
| 33 | 1.88 | 89.5 | 91.4 |
| 34 | 1.92 | 90.4 | 91.5 |

*Control: Sheet-C without any top coat.

TABLE 16

| Example | Sheet Gloss (%) | Print Gloss (%) | Delta Gloss | Change In Delta Gloss** |
|---|---|---|---|---|
| 27* | 33.3 | 67.9 | 34.6 | — |
| 28 | 41.6 | 68.4 | 26.8 | −7.8 |
| 29 | 31.7 | 82.8 | 51.1 | 16.5 |
| 30 | 31.8 | 86.1 | 54.3 | 19.7 |
| 31 | 32.0 | 86.4 | 54.4 | 19.8 |
| 32 | 36.7 | 79.3 | 42.6 | 8.0 |
| 33 | 36.4 | 78.0 | 41.6 | 7.0 |
| 34 | 36.4 | 79.1 | 42.7 | 8.1 |

*Control: Sheet-C without any top coat.
**Change In Delta Gloss = (Delta Gloss of Example n (n = 28, 29, 30, 31, 32, 33 or 34)) minus (Delta Gloss of Example 27).

Similar trends and improvements are observed as in the equal calendering condition case.

Examples 35–42

Coated sheets were prepared and tested as in Examples 1–6, except as otherwise noted. Table 17 sets forth the coating compositions for the aqueous top coat compositions of Examples 35–42.

TABLE 17

| Example | Pigment Type | Pigment (% by wt.) | Rheology Modifier[1] (% by wt.) | Binder[2] (% by wt.) | Total Solids (% by wt.) |
|---|---|---|---|---|---|
| 35* | | 0.00 | 0.00 | 0.00 | 0.00 |
| 36 | EXP3637[3] | 1.14 | 1.14 | 0.00 | 2.28 |
| 37 | DOW 711[4] | 1.14 | 1.14 | 0.00 | 2.28 |
| 38 | DOW722[5] | 1.14 | 1.14 | 0.00 | 2.28 |
| 39 | CJC1013[6] | 1.14 | 1.14 | 0.00 | 2.28 |
| 40 | CJC1014[7] | 1.14 | 1.14 | 0.00 | 2.28 |
| 41 | CJC1021[8] | 1.14 | 1.14 | 0.00 | 2.28 |
| 42 | EXP3637[3] | 1.14 | 1.14 | 0.45 | 2.73 |

*Control: Sheet-A without any top coat.
[1]ASE-60 (Rohm and Haas Company)
[2]DOW615 - styrene/butadiene binder (Dow Chemical)
[3]Experimental organic particle pigment with morphology and composition as defined in EP 0 842 992 A2, having a mean particle size of 600 nm (Rohm and Haas Company)
[4]Polystyrene plastic pigment, 300 nm average particle diameter (Dow Chemical)
[5]Polystyrene plastic pigment, 500 nm average particle diameter (Dow Chemical)
[6]Polymethylmethacrylate solid particle, 300 nm average particle diameter (Rohm and Haas Company)
[7]Polymethylmethacrylate solid particle, 500 nm average particle diameter (Rohm and Haas Company)
[8]Polymethylmethacrylate solid particle, 1000 nm average particle diameter (Rohm and Haas Company)

Table 18 sets forth the sheet gloss prior to calendering and the calendering conditions for the coated sheets of Examples 35–42.

TABLE 18

| Example | Sheet Gloss Before Calendering (%) | Calender Conditions (130° F., 600 fpm, one nip) |
|---|---|---|
| 35* | 15.9 | 20 psi |
| 36 | 4.9 | 30 psi |
| 37 | 15.0 | 20 psi |
| 38 | 10.8 | 20 psi |
| 39 | 14.6 | 20 psi |
| 40 | 9.4 | 30 psi |
| 41 | 5.3 | 50 psi |
| 42 | 6.3 | 30 psi |

TABLE 18-continued

| Example | Sheet Gloss Before Calendering (%) | Calender Conditions (130° F., 600 fpm, one nip) |
|---|---|---|

*Control: Sheet-A without any top coat.

Table 19 sets forth various properties, after calendering, for the coated sheets of Examples 35–42.

TABLE 19

| Example | Smoothness (microns) | Sheet Gloss (%) | Print Gloss (%) | Delta Gloss (%) | Change In Delta Gloss** |
|---|---|---|---|---|---|
| 35* | 2.17 | 32.2 | 62.8 | 30.5 | — |
| 36 | 1.83 | 26.8 | 75.5 | 48.7 | 18.2 |
| 37 | 2.06 | 32.5 | 73.5 | 41.0 | 10.5 |
| 38 | 2.28 | 27.6 | 72.1 | 44.5 | 13.9 |
| 39 | 2.20 | 29.2 | 72.2 | 42.9 | 12.4 |
| 40 | 1.85 | 28.3 | 76.8 | 48.4 | 17.9 |
| 41 | 1.77 | 27.8 | 76.4 | 48.7 | 18.1 |
| 42 | 1.84 | 26.9 | 75.1 | 48.3 | 17.7 |

*Control: Sheet-A without any top coat.
**Change In Delta Gloss = (Delta Gloss of Example n (n = 36, 37, 38, 39, 40, 41 or 42)) minus (Delta Gloss of Example 35).

In general, the acrylic pigments are better than the styrenic pigments and the larger particle pigments are better than the smaller particle pigments in reducing sheet gloss, resisting gloss development and in improving delta gloss.

Examples 43–49

Coated sheets were prepared and tested as in Examples 1–6, except as otherwise noted. Table 20 sets forth the coating compositions for the aqueous top coat compositions of Examples 43–49.

TABLE 20

| Example | Pigment[1] (% by wt.) | Rheology Modifier 1[2] (% by wt.) | Rheology Modifier 2[3] (% by wt.) | Total Solids (% by wt.) |
|---|---|---|---|---|
| 43* | 0.00 | 0.00 | 0.00 | 0.00 |
| 44** | 0.00 | 0.00 | 0.00 | 0.00 |
| 45[4] | 5.56 | 1.11 | 1.33 | 8.00 |
| 46[4] | 13.11 | 1.31 | 1.57 | 16.00 |
| 47[4] | 21.62 | 1.08 | 1.30 | 24.00 |
| 48[4] | 8.33 | 1.67 | 2.00 | 12.00 |
| 49[4] | 6.94 | 1.39 | 1.67 | 10.00 |

*Control 1: Sheet-A without any top coat.
**Control 2: Sheet-C without any top coat
[1]Hydrocarb HG—ultrafine calcium carbonate having a mean particle size of 350 nm with 99% less than 2000 nm (OMYA, Inc.)
[2]ASE-75 (Rohm and Haas Company)
[3]ASE-60 (Rohm and Haas Company)
[4]Coated on Sheet-C Table 21 shows various properties before calendering for the coated sheets of Examples 43–49.

TABLE 21

| Example | Brightness (%) | Opacity (%) | Smoothness (μm) | Sheet Gloss (%) | Print Gloss (%) | Delta Gloss | Change In Delta Gloss*** |
|---|---|---|---|---|---|---|---|
| 43* | 84.3 | 92.8 | 4.07 | 16.5 | 47.2 | 30.8 | — |
| 44** | 90.8 | 92.0 | 2.97 | 34.7 | 64.8 | 30.0 | — |
| 45[4] | 89.9 | 92.3 | 3.19 | 12.2 | 64.3 | 52.1 | 21.3 |
| 46[4] | 89.8 | 92.3 | 3.20 | 10.6 | 62.8 | 52.2 | 21.5 |
| 47[4] | 90.0 | 92.4 | 3.12 | 12.3 | 55.5 | 43.2 | 12.5 |
| 48[4] | 89.9 | 92.3 | 3.16 | 12.9 | 65.7 | 52.8 | 22.1 |
| 49[4] | 89.7 | 92.2 | 3.14 | 12.3 | 64.9 | 52.5 | 21.8 |

*Control 1: Sheet-A without any top coat.
**Control 2: Sheet-C without any top coat.
***Change In Delta Gloss = (Delta Gloss of Example n (n = 45, 46, 47, 48 or 49)) minus (Delta Gloss of Example 44).
[4]Coated on Sheet-C.

Table 22 shows various properties after calendering for the coated sheets of Examples 43–49.

TABLE 22

| Example | Brightness (%) | Opacity (%) | Smoothness (μm) | Sheet Gloss (%) | Print Gloss (%) | Delta Gloss | Change In Delta Gloss*** |
|---|---|---|---|---|---|---|---|
| 43* | 84.1 | 91.9 | 2.24 | 37.8 | 72.9 | 35.1 | — |
| 44** | 90.5 | 91.6 | 1.64 | 60.0 | 85.8 | 25.8 | — |
| 45[4] | 89.8 | 91.5 | 1.75 | 31.3 | 87.5 | 56.2 | 21.1 |
| 46[4] | 89.9 | 91.8 | 1.72 | 26.0 | 86.2 | 60.2 | 25.2 |
| 47[4] | 90.1 | 91.8 | 1.67 | 31.1 | 82.2 | 51.1 | 16.0 |

TABLE 22-continued

| Example | Brightness (%) | Opacity (%) | Smoothness (μm) | Sheet Gloss (%) | Print Gloss (%) | Delta Gloss | Change In Delta Gloss*** |
|---|---|---|---|---|---|---|---|
| 48[4] | 89.9 | 91.6 | 1.69 | 30.2 | 86.3 | 56.1 | 21.0 |
| 49[4] | 89.7 | 91.2 | 1.57 | 30.5 | 86.9 | 56.5 | 21.4 |

*Control 1: Sheet-A without any top coat.
**Control 2: Sheet-C without any top coat.
***Change In Delta Gloss = (Delta Gloss of Example n (n = 45, 46, 47, 48 or 49)) minus (Delta Gloss of Example 44).
[4]Coated on Sheet-C.

Examples 50–59

Coated sheets were prepared and tested as in Examples 1–6, except the coating compositions for the aqueous top coat contain only water and pigment, albeit at varying solids levels (the pigment being binder coated and therefor providing the bonding to the substrate itself), and the base sheet is similar to the Sheet-C, but calendered to have a TAPPI 75 degree gloss of 69.6. Table 23 shows various properties, without calendering, of the coated sheets of Examples 50–59.

TABLE 23

| Example | Pigment[1] (% by wt.) | Sheet Gloss (%) | Print Gloss (%) | Delta Gloss | Change In Delta Gloss** |
|---|---|---|---|---|---|
| 50* | None | 69.6 | 92.8 | 23.2 | — |
| 51 | 0.125 | 44.4 | 87.8 | 43.4 | 20.2 |
| 52 | 0.250 | 28.6 | 79.7 | 51.1 | 27.9 |
| 53 | 0.334 | 23.8 | 83.6 | 59.8 | 36.5 |
| 54 | 0.500 | 14.4 | 78.7 | 64.3 | 41.1 |
| 55 | 0.750 | 12.7 | 77.7 | 65.0 | 41.7 |
| 56 | 1.000 | 12.0 | 78.3 | 66.3 | 43.1 |
| 57 | 1.500 | 16.2 | 74.6 | 58.4 | 35.2 |
| 58 | 2.000 | 25.8 | 72.3 | 46.5 | 23.3 |
| 59 | 10.000 | 59.4 | 91.6 | 32.2 | 9.0 |

*Control: Base sheet, similar to Sheet-C but calendered to 69.6 units of sheet gloss.
**Change In Delta Gloss = (Delta Gloss of Example n (n = 51, 52, 53, 54, 55, 56, 57, 58 or 59) minus (Delta Gloss of Example 50).
[1]Binder coated hollow sphere pigment BC-643 (Rohm and Haas Company)

Within the pigment concentration range of 0.5 to 1.5%, the calendered base sheet gloss was decreased from 69.6 units to well below 20 units, i.e. by about 50 units, while the print gloss was only decreased by 15 units or less. This provides a print delta gloss improvement of more than 35 units. At a pigment concentration of 10% solids, the top coat became a more than a mono-layer coating and the uncalendered sheet gloss reached a fairly high value, i.e. 59.4, again.

What is claimed is:

1. A paper having an improved print quality, comprising:

(i) a paper substrate, said paper substrate having a front and a back, and a surface on at least one of said front and said back of said paper substrate, said surface having a surface roughness of less than 6 microns and a surface gloss of 5–80%; and (ii) a top coat disposed on said surface, said top coat comprising at least one binder coated pigment, said binder being present in an amount of 1–50 wt % based on the weight of said at least one pigment, said at least one pigment having an average particle diameter of 200 to 2000 nm, said top coat being a partial mono-layer of particles of said at least one pigment or clusters of said particles of said at least one pigment.

2. The paper having an improved print quality as claimed in claim 1, wherein said at least one pigment is a mineral pigment.

3. The paper having an improved print quality as claimed in claim 1, wherein said at least one pigment is a synthetic plastic pigment.

4. The paper having an improved print quality as claimed in claim 1, wherein said at least one pigment comprises synthetic plastic pigment particles comprising at least one polymer core phase containing at least one void, at least one polymer shell phase at least partially surrounding said core, and at least one channel connecting said void in said core to the exterior of said particle.

5. The paper having an improved print quality as claimed in claim 1, wherein said top coat further comprises an optical brightening agent in an amount of 0.1 to 20 parts by weight for each 100 parts by weight of said at least one pigment.

6. The paper having an improved print quality as claimed in claim 1, wherein said top coat has been calendered to increase its sheet gloss to a value not greater than 50%.

7. The paper having an improved print quality as claimed in claim 1, wherein said surface is formed by at least one coating disposed on at least one of said front and said back of said paper substrate.

8. A process of making a paper having an improved print quality, comprising:

(i) providing a paper substrate, said paper substrate having a front and a back, and a surface on at least one of said front and said back of said paper substrate, said surface having a surface roughness of less than 6 microns and a surface gloss of 5–80%; and (ii) applying an aqueous top coat over said surface, said aqueous top coat having a solids content of 1 to 40% by weight, said aqueous top coat composition comprising water and at least one binder coated pigment, said binder being present in an amount of 1–50 wt % based on the weight of said at least one pigment, said at least one pigment having an average particle diameter of 200 to 2000 nm, said top coat being a partial mono-layer of particles of said at least one pigment or clusters of said particles of said at least one pigment; and (iii) drying said aqueous top coat.

9. The process as claimed in claim 8, wherein said aqueous top coat composition has a solids content of 10 to 40% by weight.

10. The process as claimed in claim 8, wherein said aqueous top coat composition has a solids content of 25 to 35% by weight.

11. The process as claimed in claim 8, further comprising calendering said dried cop coat to produce a surface gloss of not more than 50%.

12. The process as claimed in claim 8, wherein said dried top coat is calendered to produce a surface gloss of not more than 30%.

13. The process as claimed in claim 8, wherein said aqueous top coat further comprises an optical brightening agent in an amount of 0.1 to 20 parts by weight for each 100 parts by weight of pigment.

* * * * *